United States Patent [19]

Storm

[11] Patent Number: 4,747,390

[45] Date of Patent: May 31, 1988

[54] TARGET PROJECTOR

[76] Inventor: Nelson Storm, 213 Perry St., Rossville, Ill. 60963

[21] Appl. No.: 832,533

[22] Filed: Feb. 24, 1986

[51] Int. Cl.[4] ..... F41J 9/30

[52] U.S. Cl. ..... 124/6; 124/47; 221/298

[58] Field of Search ..... 124/4–9, 124/47; 221/298

[56] References Cited

U.S. PATENT DOCUMENTS

| | | | |
|---|---|---|---|
| 1,050,788 | 1/1913 | Baltzley | 221/298 X |
| 1,270,194 | 6/1918 | Nybak | 221/298 X |
| 1,287,002 | 12/1918 | Grover | 221/298 X |
| 1,313,046 | 8/1919 | Anderson | 221/298 |
| 2,171,623 | 9/1939 | Connell | 124/6 |
| 2,351,869 | 6/1944 | Mossberg | 124/8 X |
| 2,432,155 | 12/1947 | Herold | 124/6 |
| 3,368,542 | 2/1968 | Dale | 124/8 |
| 3,417,741 | 12/1968 | Hansen | 124/8 |
| 3,822,688 | 7/1974 | Mayne | 124/6 |
| 4,157,828 | 6/1979 | Cosmopulus | 124/5 X |
| 4,300,520 | 11/1981 | Laporte et al. | 124/9 |

FOREIGN PATENT DOCUMENTS

| | | | |
|---|---|---|---|
| 530121 | 9/1956 | Canada | 124/5 |
| 1,920,878 | 11/1970 | Fed. Rep. of Germany | 124/6 |
| 2334082 | 7/1977 | France | 124/47 |

*Primary Examiner*—Paul E. Shapiro

*Attorney, Agent, or Firm*—Witherspoon & Hargest

[57] ABSTRACT

A target projector for projecting a disc-like target adapted for operation by electric power, the projector includes a base with a drive shaft rotatably mounted thereon, an electric motor is operatively connected to the drive shaft to rotate same, a throwing arm has an inner end and an outer end portion and is connected to the drive shaft for rotation therewith, a target magazine is positioned adjacent and above the inner end portion of the throwing arm, said magazine being adapted to hold a stack of disc-like targets. A mechanism is provided for depositing targets one at a time from the target magazine into the inner end portion of the throwing arm and then retaining the target therein, and an electrical switch and control components are adapted for connection to an electrical power source for controlling the power to the electric motor and the mechanism for depositing targets one at a time in the inner end portion of the throwing arm and then retaining the target therein, whereby the electric motor is energized to rotate the drive shaft and the throwing arm connected thereto, a single target is deposited and retained in the inner end portion of the throwing arm and then after a timed period the target is freed and then projected outwardly from the throwing arm by centrifugal force.

10 Claims, 4 Drawing Sheets

TARGET PROJECTOR

This invention relates to target projectors and more particularly a target projector especially useful in the sport of trapshooting wherein a projecting device called a trap tosses targets into the air for the sportsman to shoot down. The targets are generally discs made of coarse clay or clay and pitch and are commonly called clay pigeons. The name trapshooting is apparently derived from an early practice wherein a plurality of spaced traps were formed in the ground. In each trap a live pigeon was held by the trap operator. Upon signal from the sportsman the pigeon was released and fired upon by the sportsman.

BACKGROUND AND OBJECTS

The most common type of trapshooting apparatus is one which is powered by a strong spring that must be retracted to provide the power for throwing the target. Obviously, at the end of the throwing operation a substantial amount of spring energy still remains and must be disspated. In other words, when the spring powered throwing arm stops its swing substantial amounts of energy not absorbed by throwing the target must be absorbed by the projector mechanism. Such requires apparatus of rather heavy weight which means that conventional traps are not easily moved. Careful anchoring of spring powered traps is necessary in order to make certain that target projection is consistently within prescribed limits.

There has long been a need for a portable light weight trap which would be reliable and relatively inexpensive to manufacture.

In view of the foregoing it is an object of this invention to provide a target projector which is of light construction so as to be portable.

It is another object of this invention to provide a portable target projector that is durable and requires very little maintenance.

It is yet another object of this invention to provide a target projector as set forth in the preceding objects which has a continuously rotating throwing arm for projecting targets.

It is a still further object to provide a target projector as set forth above and which has the capability of random or directional target projection.

It is another object of this invention to provide a target projector that is remotely operable and needs no attendant at the target projector.

The above and additional objects and advantages will become more apparent when taken in conjunction with the folliwng detailed description and drawings disclosing a preferred embodiment of this invention.

IN THE DRAWINGS

FIG. 1 is an elevational view of the target projector illustrating the device in it's at rest position.

FIG. 2 is an enlarged elevational view of a portion of FIG. 1 showing the manner in which the targets are dispensed into the projecting arm, FIG. 3 is a schematic diagram illustrating the electrical components of the projector, FIG. 4 is a plan view of one of the feed and/or retainer fingers, FIG. 5 is an elevational view of the throwout bushing assembly, FIG. 6 is a plan view of the rotating and sliding yoke, FIG. 7 is a plan view of the non revolving and lower yoke, FIG. 8 is a plan view of an alternative form of throwing arm and, FIG. 9 is an end view of the throwing arm shown in FIG. 8.

DETAILED DESCRIPTION

Figure 1:
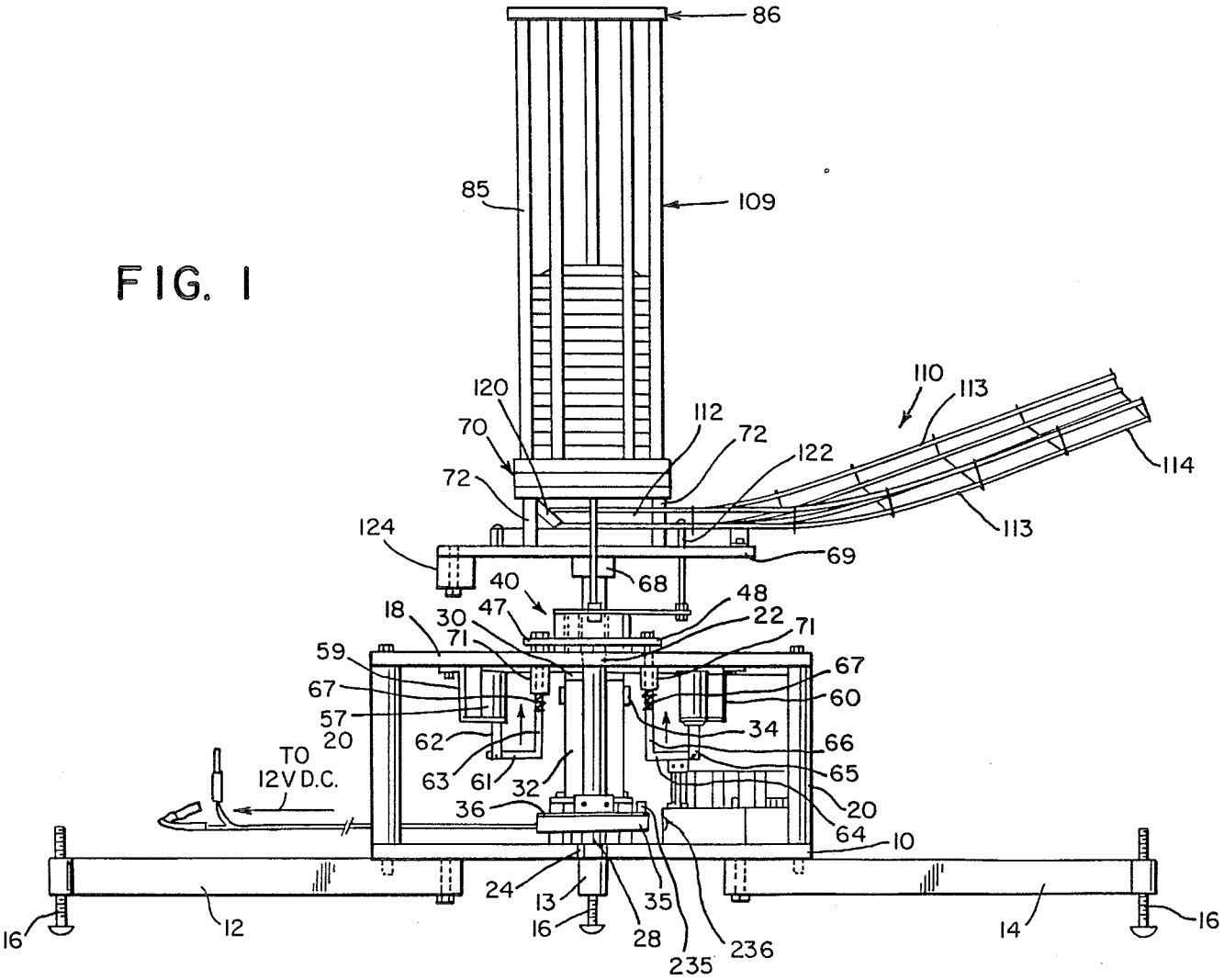

The trapshootting target projector of this invention comprises a triangular base plate 10 with support members 12, 13 and 14 connected to and extending outwardly therefrom. The outer portion of each support member is provided with an adjusting screw 16 for levelling purposes. A triangular upper plate 18 is spaced from and above base plate 10 and is retained in such position by means of three spacer bolt assemblies 20. The upper plate 18 and base plate 10 are each provided with a centrally disposed hole 22 and 24 respectively which are vertically and axially aligned. A drive shaft 26 is positioned through the aforesaid holes 22 and 24 and rotatably carried by bearings 28 and 30.

An electric motor 32 is held on base plate 10 by means of motor mounting bracket 34 suitably secured to the base plate 10. A gear pulley 36 is affixed to drive shaft 26 near the base plate 10 with a belt 38 operatively connecting the aforesaid gear pulley 36 to the electric motor 32 so as to provide rotation to the drive shaft 26.

Figure 7:
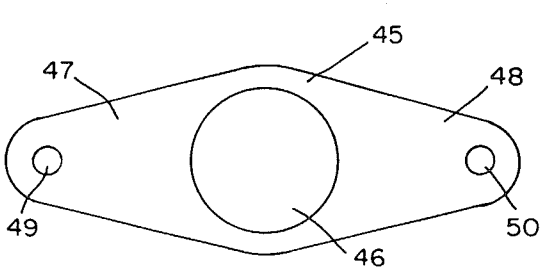
Figure 6:
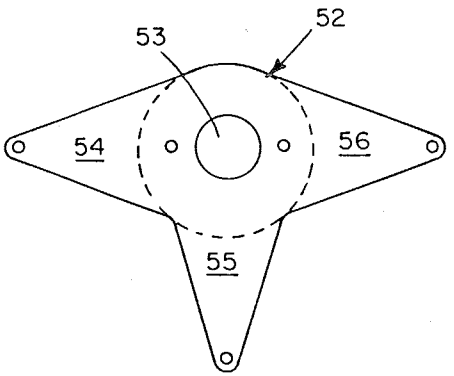
Figure 5:
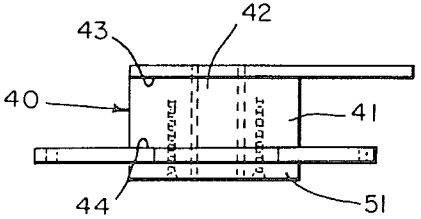

A throwout bushing assembly 40 is freely mounted on drive shaft 26 above upper plate 18. As best shown in FIGS. 1 and 5 the throwout bushing assembly 40 comprises a circular bearing 41 having a central hole 42 for freely mounting on the drive shaft 26 above the upper plate 18, said bearing having a top 43 and a bottom 44. Referring to FIGS. 1 and 7 a non revolving yoke 45 having a center hole 46 freely fits around drive shaft 26 and adjacent the bearing bottom 44. Said yoke 45 has ears 47 and 48 extending diametrically outward from the yoke hole 46 with aperture 49 and 50 respectively. A washer 51 is secured to circular bearing 41 to retain the non revolving yoke 45 in position. As shown in FIGS. 1 and 6 rotating and sliding yoke 52 having a central hole 53 is fitted around drive shaft 26 and secured to the top 43 of the circular bearing 41. Said yoke 52 has three arms 54, 55 and 56 extending outwardly therefrom and spaced approximately 90° apart with respect to the yoke hole 53. It should be noted that a bronze bearing sleeve 43 fits around drive shaft 26 and in engagement with the sides of hole 42.

Figure 2:
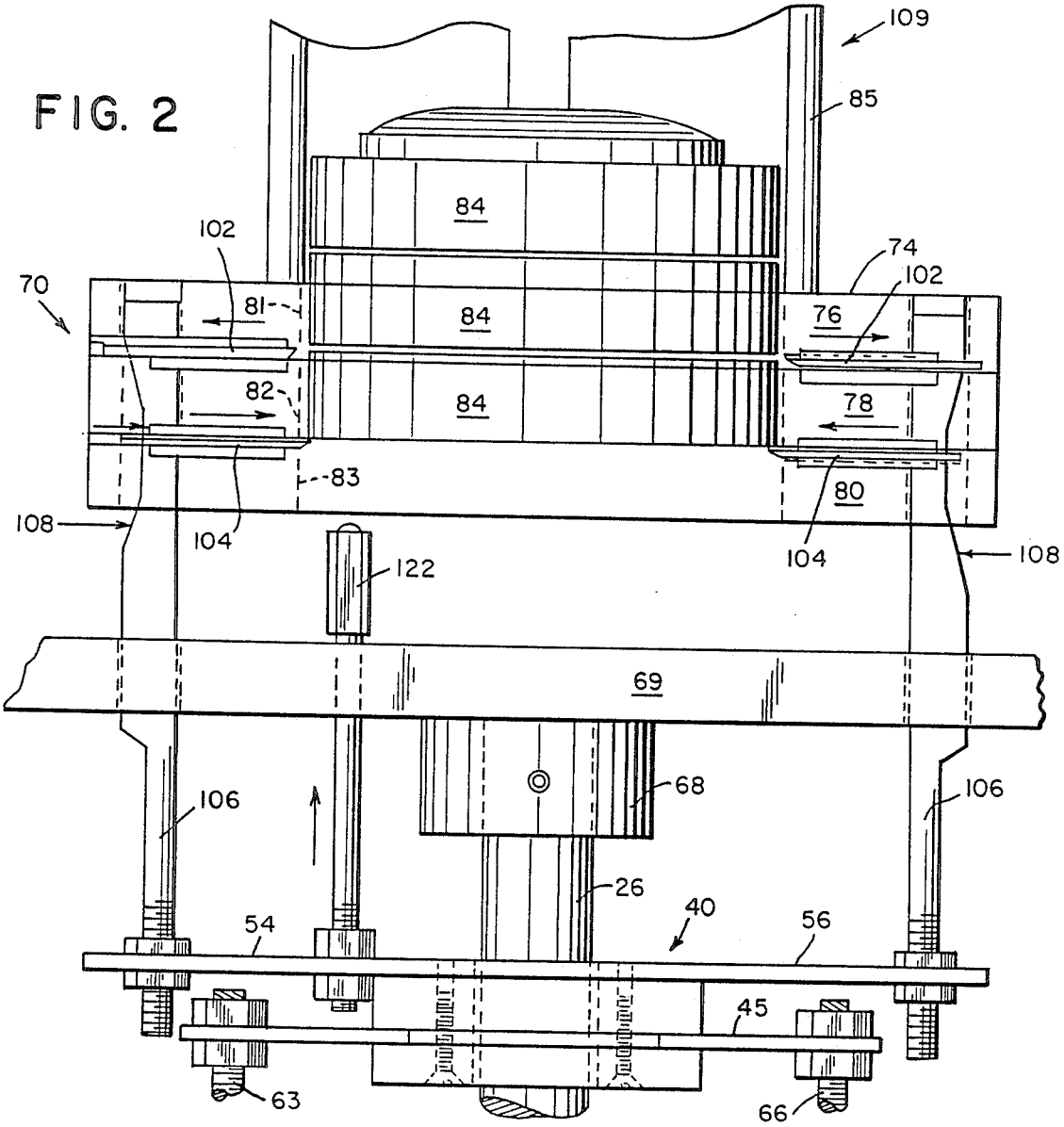

Referring to FIG. 1 a pair of solenoids 57 and 58 are mounted on the underside of upper plate 18 by means of brackets 59 and 60 respectively. An "L" shaped bracket 61 is attached to armature 62 of solenoid 57 with its long leg 63 extending freely upwardly through upper plate 18 and then connected to ear 47 of yoke 45. Similarly, an "L" shaped bracket 64 is attached to armature 65 of solenoid 58 with its long leg 66 extending freely upwardly through upper plate 18 and then connected to ear 48 of yoke 45. Return spring means 67 are fitted around bracket legs 63 and 66 to cause the solenoid armature to smartly return to at rest position. Guides 71 are fitted around the long legs 63 and 66 to further smooth out reciprocation of said legs. As best shown in FIGS. 1 and 2 an end collar 68 is affixed to the upper end of the drive shaft 26 while a support plate 69 is firmly mounted on the free end of collar 68 with portions extending diametrically outward therefrom. A feeder head 70 is positioned above the support plate 69 and is held in such position by a plurality of spacer assemblies 72 affixed to the feed head 70 and support plate 69. The feeder head 70 comprises an annular body 74 made up of three annular plates 76, 78 and 80 suitably held together. Each of the annular plates 76, 78 and 80 is provided with a central hole 81, 82 and 83 respectively to provide a smooth cylindrical opening whose vertical axis is aligned with the axis of the drive shaft 26, said holes being sized to allow passage of a disc-like target 84 therethrough when said disc 84 is in a horizontal position.

Figure 4:
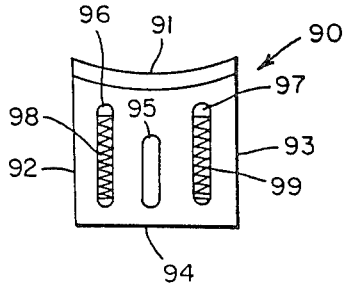

As shown in FIGS. 2 and 4, the feed fingers 104 and the retainer fingers 102 both are spring biased toward the drive shaft 26 and are similarly shaped, each finger comprises a forward curved face 91 corresponding generally to the outer curvature of the target disc 84 with parallel sides 92, 93 and a square backside 94. A central cam slot 95 is positioned between srping slots 96 and 97 carrying springs 98 and 99 which, when the fingers are assembled in the annular body 74 will bias the fingers inwardly.

As illustrated in FIG. 2, the retainer fingers 102 are slidably carried in the annular body 74 for radially inward and outward movement with the curved end 91 facing inwardly. Similar arrangement is provided by the feed fingers 104 positioned below the retainer fingers 102 by an amount slightly greater than the thickness of the target disc 84. Linear cams 106 vertically reciprocate within the annular head 74 and have their lower ends secured to diametrically positioned arms 54 and 56 of yoke 52. The operative portions of the linear cams 106 are slidable fitted within cam slots 95 whereby the cam surface 108 will provide for inward and outward movement of the respective fingers as the arms 54 and 56 are vertically reciprocated.

A cylindrically shaped magazine unit 109 is affixed to the annular head 74 and is sized to carry targets 84 as shown in FIGS. 1 and 2. More specifically, the cylindrically shaped magazine 109 comprises a plurality of vertically disposed rods 85 forming a circle slightly larger than the disc-like targets 84 which are stored therein. The bottom ends of rods 85 are affixed to the upper end portion of the feeder head 74 while the upper ends are secured to sizing ring 86. The function of the sizing ring 86 is to make certain that all disc targets 84 that pass into magazine 109 are the proper size. The vertical axis of the cylindrically shaped magazine 109 is coaxial with the vertical axis of the hole formed by holes 81, 82 and 83 in the three annular plates 76, 78 and 80 which form the feeder head 74. A target projecting or throwing arm 110 having an inner end 112 and an outer end 114 is mounted on support plate 69 and positioned with its inner end portion 112 under the annular feeder head 74 to receive disc type targets 84 from magazine unit 109. The linear projecting arm 110 is made up of a plurality of longitudinally extending rods 113 held in spaced relationship and sized to freely carry the disc type targets which are to be projected therefrom by centrifugal force. The inner end portion 112 is provided with an angularly positioned ramp 120 which engages a portion of the dropped target 84 and forces it slightly outboard and thus off center in the projecting arm 110 so that centrifugal force developed by the rotation of the arm 110 will force the target against target retaining pin 122 which is attached at its lower end to arm 55 of yoke 52 whereby said pin 122 will be raised or lowered in response to vertical reciprocation of yoke 52. As is apparent, with the projecting arm 110 rotating and the target 84 bearing against the retaining pin 122 under the action of centrifugal force when the pin is withdrawn the target proceeds out the throwing arm and is tossed in the air. In order to aid in balancing of forces, a counter weight 124 is affixed to the support plate 69 diametrically opposite in direction from the throwing arm 110 to maximize its effectiveness.

Prior to describing in detail the electrical circuitry and components thereof a brief outline of the basic operation of the target projector would be in order. With the projector properly set up and the feeder filled with target discs 84 the motor is started to rotate drive shaft 26 and all of the components connected thereto from the throwout bushing 40 upward. Upon proper switching solenoids 57 and 58 are energized causing their armatures to move upwardly together with "L" shaped brackets 61 and 64 to raise throwout bushing 40. Upward movement of bushing 40 forces linear cams 106 to slide upwardly to thereby cause retainer fingers 102 to move inwardly to engage and hold the stack of discs 84 while the feed fingers 104 move outwardly to allow a disc 84 to drop into the inner end portion 112 of throwing arm 110. The edge of the disc 84 as it drops is engaged by ramp 120 to force it slightly outward in arm 110 so that it is off center whereby centrifugal force will move the disc outwardly against retaining pin 122. Deenergization of solenoids 57 and 58 will cause the throwout busing 40 to move downwardly thus causing retaining pin 122 to move out of engagement with the disc 84 and allow it to be projected from the throwing arm 110 by centrifugal force. The return springs 67 fitted around the legs 63 and 66 of "L" shaped brackets 61 and 64 assist in rapid return of the mechanism to ready position. As the overall downward movement takes place linear cams 106 move downwardly to cause feed fingers 104 to move inwardly and retainer fingers 102 to move outwardly whereby the stack of discs 84 will be allowed to move downwardly one disc to be ready for next firing.

Figure 3:
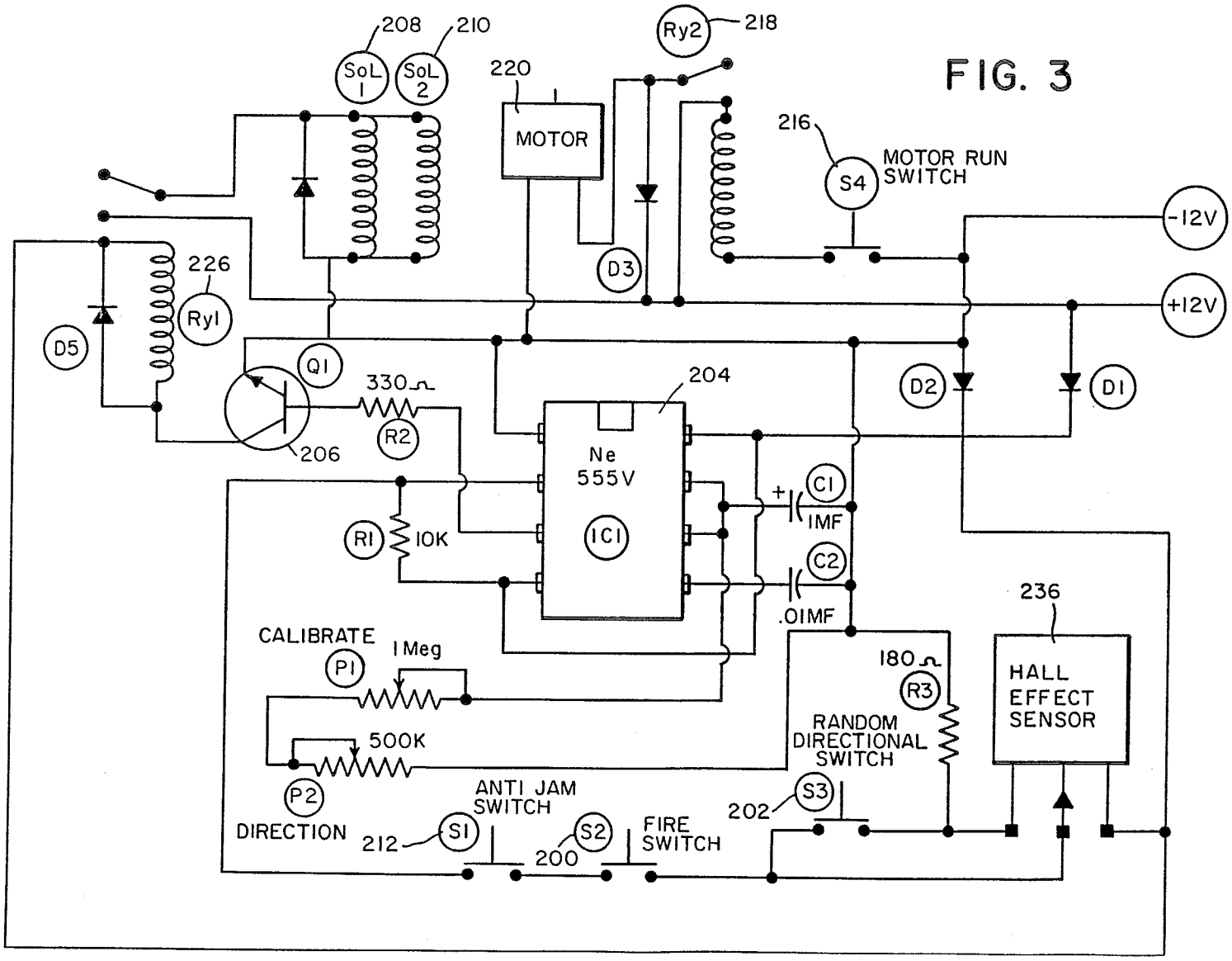

The electrical components and circuitry are illustrated in FIG. 3. The control system comprises two modes of operation, one is the random mode of throwing while the second is the directional mode of throwing. In the operation of this unit the throwing arm 110 is continuously rotated at or about 475 R.P.M. This is accomplished by closing switch 216 which is part of the remote control unit. Closing of switch 216 energizes relay 218 thereby energizing motor 220 which drives the drive shaft 26 through a belt and pulley arrangement.

In the random mode operation the fire button 200 is depressed on the remote control unit with the random-directional switch 202 in the open (random position) this immediately energizes the NE 555 V timer integrated circuit unit 204. This in turn energizes the transistor 206 to fire relay 226 to close the circuit to energize solenoids 208 and 210. These solenoids are the same as solenoids 57 and 58 shown in FIG. 1. As previously explained energization of the solenoids 57 and 58 causes a disc target 84 to be deposited in the inner end portion 112 of the throwing arm 110 where ramp 120 causes the disc 84 to move off center in the throwing arm whereby centrifugal force will cause the disc 84 to move outwardly and engage retaining pin 122. At the same time anti-jam switch 212 is closed to thereby prevent the system from firing again prior to the completion of the cycle. After the time cycle for random mode has elapsed the timer 204 will deenergize the coil of relay 226 thus deenergizing the solenoids 208 and 210 so that their armatures will return to the at rest position with the aid of the associated return springs. This action causes retaining pin 122 to move downwardly to thereby free the disc 84 so that it may be projected by the throwing arm 110. In this mode the direction of throw will be undetermined.

In the directional mode of operation, switch 202 is closed and with the fire button 200 having been depressed, a directional cycle will start as soon as the Hall effect Sensor 236 is activated. This is accomplished when the magnet 235 located on the belt pulley 36 passes by the sensor 236 to cause it to turn on briefly thereby triggering a timing cycle for directional mode. This signal as in the random mode proceeds the timer unit 204 so that the electrical functions may be carried out as in the random mode for projecting of a disc 84. This timing cycle is controlled by adjusting potentiometer 238 to control the amount of timing delay while adjustment of potentiometer 240 is used to calibrate the timing circuit to achieve a predictable release point.

The entire electrical set up is powered by a 12 volt d.c. power source. This makes the unit readily portable from a power stand point.

Figure 9:
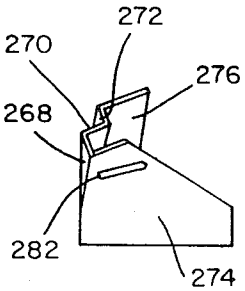
Figure 8:
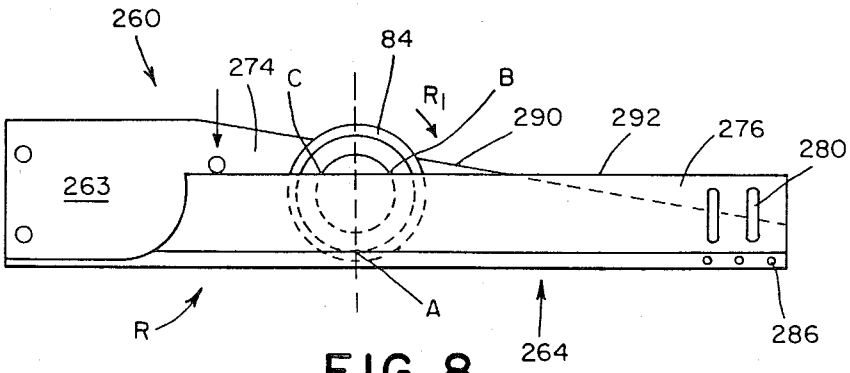

An alternative throwing arm 260 is shown in FIGS. 8 and 9 and comprises a base portion 262 with a U-shaped portion 264 extending outwardly therefrom. The closed portion of the U-shaped configuration is formed in an offset arrangement designed to generally conform to the profile of the disc target 84. As shown in FIG. 9, the offset portion comprises longitudinal panels 268, 270 and 272 with flat bottom guide 274 extending from the edge of panel 268 and flat top guide panel 276 extending from the edge of panel 272, guide panels 274 and 276 being parallel to each other. The offset arrangement is advantageous in that the profile of the disc target 84 fits into such offset to thereby aid in maintaining proper attitude in the projecting operation. In addition, panels 274 and 276 may be provided with a plurality of slots 280 and 282 while the offset panels 268, 270 and 272 may be provided with holes 286 throughout all or just a portion of their length.

The throwing arm 260 rotates in what could be termed counter clockwise direction as indicated by arrow R. The bottom guide panel 274 has its leading edge 290 tapered from the base portion 262 outwardly whereby the width of bottom guide panel 274 decreases with its minimum width at the outermost end. The leading edge 292 of the top guide panel 276 is straight with a constant width amounting to approximately $\frac{2}{3}$ of the diameter of the disc target 84. It should be noted that target disc 84 as it proceeds outwardly from the base 262 rotates in a direction $R_1$ opposite to that of the throwing arm 260. As the target disc 84 proceeds outwardly the tapered leading edge 290 of lower guide panel 274 exposes more and more of the bottom side of the disc 84 causing it to be lifted slightly so that the disc 84 will basically engage points A, B and C thereby substantially lessening the friction and yet allowing the disc 84 to rotate in direction $R_1$ with increasing revolutions. The lifting of disc 84 as it moves outwardly under the effect of the air engaging the under surface of the disc 84 plus the rotation of same greatly enhances the smooth launching of the disc from the throwing arm 260.

In order to further assist in the practice of this invention the electrical components are listed below:

(ICL) Ne555V integrated circuit. This is an 8 Pin minidip Timer IC (Hall Effect Sensor) This is a digital, solid state, magnetically activated switch. Micro Switch #8SS3E1.

D1 DE lamp 100 Piv diodes are used to prevent possible damage caused by attaching the battery cables incorrectly.

D3 D4 D5 Diodes (lamp 100 piv) are used to eliminate false triggering caused by relay and solenoid coils which produce rottage spikes when engaged and disengaged.

C1 Imf. 50 VDC electrolyte capacitor controls length of Time Cycle.

C2 0.01 mf. 50 VDC Capacitor Component interface.

R1 10 K $\frac{1}{4}$ Water resistor. Pull up resistor to minimize the effect of small leakage currents from the output of the device or sensor 8SS3E1 or the components with which they are interfaced.

R2 330 $\frac{1}{4}$ watt resistor to interface the IC (Ne555V) to Q1.

R3 180 $\frac{1}{4}$ watt resistor to limit current to Hall Effect Sensor.

Q1 NPN transistor to drive Ry1 relay coil.

S1 Normally open switch attached to the solenoid assembly to disconnect firing circuit during timing cycle. (anti-Jam).

S2 Normally open S.P.S.T. momentary contact switch. Used to fire Clay Birds from the remote.

S3 S.P.S.T. Toggle switch to select random or directional mode.

S4 S.P.S.T. motor run switch to turn motor off/on from remote.

P1 Potentiometer 1 Meg, screwdriver adjustable, P.C. mount. To calibrate directional system.

P2 500 K Potentiometer for user to select direction of Clay Bird release.

Ry1 D.P.D.t. 12 V. D.C. Relay with 10 A contact rating to fire solenoids.

Ry2 S.P.S.T. 12 V. D.C. 10 Amp contact rating relay to control motor.

$SoL_1$ $SoL_2$ Solenoids to operate mechanism to fire birds.

Based on the foregoing detailed description it is apparent that the target projector of this invention has numerous advantageous, some of which are:

(1) Light weight and portable.
(2) 12 Volt D.C. powered.
(3) Apparatus may be remotely controlled.
(4) Apparatus is magazine fed.
(5) Feed is of repeating nature.
(6) No trap boy needed.
(7) Will throw targets in rapid succession.
(8) Apparatus can be operated by the shooter.
(9) The throwing arm is rotated to develop centrifugal force for projection.
(10) The throwing arm of this device rotates continuously.
(11) It is very easy to set up apparatus.
(12) The device may be easily reduced to transporting condition.
(13) The above and additional advantages will become apparent upon use of this device The choice of materials used for the various components of the projector is controlled by characteristics such as strength, anti-corrision quality, appearance and general durability as well as cost per se.

What is claimed is:

1. A target projector for projecting a disc-like target and adapted for operation by electric power, said projector comprising:

(1) a base,
(2) a drive shaft rotatably mounted on said base,
(3) an electric motor operatively connected to said drive shaft to rotate it,
(4) a throwout bushing assembly freely carried on the drive shaft said throwout bushing including a lower yoke slidable with respect to the drive shaft but non rotatable with respect thereto and an upper yoke slidable with respect to the drive shaft and rotatable therewith,
(5) solenoid means on the base operatively connected to the lower yoke to raise and lower the throwout bushing on the drive shaft,
(6) a support plate affixed to the drive shaft for rotation therewith,
(7) a target magazine mounted in spaced relation to and above the support plate, said target magazine being adapted to carry a stack of disc-like targets,
(8) a throwing arm mounted on the support plate, said throwing arm having an inner end portion and an outer end portion with the inner end portion positioned under the target magazine,
(9) linear cam means secured to the upper yoke and in operative engagement with the target magazine for the dispensing of one target at a time from the magazine into the inner end portion of the throwing arm,
(10) Retaining means also connected to the upper yoke to protrude into the inner end portion of the throwing arm to retain the dispensed target therein,
(11) whereby with deenergization of the solenoid means the retaining means will be moved to free the target for projection by the throwing arm.

2. The invention as set forth in claim 1 and wherein a ramp is provided to direct the target slightly off center and outwards in the throwing arm and up against the retaining pin when dispensed from the target.

3. The invention as set forth in claim 1 and wherein electrical switch and control means adapted for connection to an electrical power source are provided for controlling:

(a) power to the electric motor means and,
(b) power to the solenoid means for moving the throwout bushing to operate the linear cams secured to the upper yoke for dispensing targets one at a time into the inner end portion of the throwing arm.

4. The invention as set forth in claim 3 and including means for controlling the time period after which the target is freed and then projected outwardly from the throwing arm by centrifugal force.

5. The invention as set forth in claim 4 and including an electrical index means whereby the timing will start from the same point of rotation each projecting cycle to project the target in the same specific direction in successive cycles.

6. The invention as set forth in claim 1 and wherein the throwing arm having an inner end and an outer end portion comprises a base forming the inner end portion with a U-shaped guide assembly extending from said base and terminating in an outer end portion, whereby the disc will travel outwardly in the guide assembly as it is projected.

7. The invention as set forth in claim 6 and wherein the U-shaped guide assembly comprises a top guide panel and a bottom guide panel spaced therefrom with a connecting panel having a configuration in cross section generally matching that of the target disc.

8. The invention as set forth in claim 7 and wherein the free edge of the bottom guide panel is tapered so as to decrease the width of said panel in an outward direction to expose a portion of the underside of the target disc as it travels outwardly in the guide assembly so that air may act on the said underside to lift the target disc thereby lessening frictional engagement of the disc with the guide assembly.

9. The invention as set forth in claim 8 and wherein the top guide panel has a width less than the diameter of the target disc wherein the target disc will tilt upwardly under the influence of the air on the underside of the target disc to further decrease friction and allow the target disc to rotate an additional number of revolutions to further assist a smooth launching.

10. The invention as set forth in claim 9 and wherein the top guide panel, the bottom guide panel and the connecting panel are provided with openings to further reduce air resistance.

* * * * *